US005203664A

United States Patent [19]

Jensen

[11] Patent Number: 5,203,664

[45] Date of Patent: Apr. 20, 1993

[54] WASTE CONTAINER FOR HANDLING WITH FRONT LOADING MEANS

[75] Inventor: Torben B. Jensen, Aalborg, Denmark

[73] Assignee: Vecto Hydraulic A/S, Aalborg, Denmark

[21] Appl. No.: 623,991

[22] PCT Filed: Jun. 19, 1989

[86] PCT No.: PCT/DK89/00148

§ 371 Date: Dec. 20, 1990

§ 102(e) Date: Dec. 20, 1990

[87] PCT Pub. No.: WO89/12591

PCT Pub. Date: Dec. 28, 1989

[30] Foreign Application Priority Data

Jun. 20, 1988 [DK] Denmark ..... 3369/88

[51] Int. Cl.[5] ..... B65F 3/04

[52] U.S. Cl. ..... 414/407; 220/331; 220/908; 414/408; 414/421

[58] Field of Search ..... 414/403, 404, 406, 407, 414/408, 409, 419, 420, 421, 422, 423, 424; 220/908, 909, 910, 331, 212, 288, 345; 294/68.26, 68.27, 68.2

[56] References Cited

U.S. PATENT DOCUMENTS

| | | | |
|---|---|---|---|
| 1,122,902 | 12/1914 | Gassler | 414/407 |
| 1,180,292 | 4/1916 | Harris | 414/407 X |
| 4,211,745 | 7/1980 | Boyd | 414/408 X |
| 4,320,852 | 3/1982 | Nagelkirk . | |
| 4,373,849 | 2/1983 | Robinson | 414/408 |
| 4,697,836 | 10/1987 | Dutkanyeh | 414/407 X |
| 4,821,902 | 4/1989 | May | 220/331 X |
| 4,878,596 | 11/1989 | Cawley et al. | 220/908 X |

FOREIGN PATENT DOCUMENTS

| | | | |
|---|---|---|---|
| 140980 | 7/1974 | Denmark . | |
| 101475 | 2/1983 | European Pat. Off. . | |
| 2337403 | 2/1975 | Fed. Rep. of Germany | 414/421 |
| 2741448 | 3/1979 | Fed. Rep. of Germany | 414/407 |
| 2913436 | 4/1979 | Fed. Rep. of Germany . | |
| 1112954 | 3/1956 | France . | |
| WO8301647 | 5/1983 | PCT Int'l Appl. . | |
| 673540 | 7/1979 | U.S.S.R. | 220/331 |

*Primary Examiner*—Frank E. Werner

*Attorney, Agent, or Firm*—Antonelli, Terry, Stout & Kraus

[57] ABSTRACT

The container is adapted to be lifted and swung upwards and rearwards across the driver's cab of the vehicle to an emptying position over a collecting receptacle on the vehicle; the container being provided with one or more cover members which can be opened for emptying and/or filling is pivotably and movable connected at the upper side edge portions of the container such that when the cover plate member is turned upwards, for example, when the container is standing on the ground, may be moved and pivoted away from the container in order to open one side thereof. The cover plate member, when turned downwards, for example, during the emptying of the container, automatically during movement may be pivoted away from the container in order to empty the container, and when the cover plate member, is again turned upwards, for example, after the container is emptied, the container automatically is pivoted back, closing the container.

4 Claims, 4 Drawing Sheets

WASTE CONTAINER FOR HANDLING WITH FRONT LOADING MEANS

The present invention relates to a waste container for handling with front loading means.

For many years it has been common to make use of containers for collecting waste and in that connection it has been common practice with the emptying of containers to change a filled waste container with an empty container in order to minimize driving. However, this method requires a very large number of containers to minimize the frequency of the emptying the number of containers.

Recently, a new container principle has been realized where the use of smaller containers is made by emptying the smaller containers by using in situ—as use is made of a truck with a larger collecting receptacle which furthermore includes a compacting system so that the collecting receptacle may contain a very considerable amount of waste. Smaller containers are used in order to lighten the handling during the emptying by utilizing lifting arm system with lift-forks at the front end of the collecting vehicle as the container is emptied and upwardly swung and rearwardly across the driver's cab of the vehicle to a emptying position above the collecting receptacle of the vehicle. By this principle smaller containers which are more often emptied involves advantages both regarding the investment requirement and the milieu as it also concerns perishable waste and so called risk related waste.

However, known waste containers for front loading are subject to some constructive disadvantages which contribute both to impede the emptying operation itself and to reduce the practical use of front loading containers. By the known waste containers of the type in question, it is the cover construction which creates problems.

By way of example, a known front loading container is provided with an upper cover having two parts which before the emptying operation has to be manually opened by swinging the respective cover parts upwardly and rearwardly about hinges at the front side and the rear side, respectively, of the container and furthermore by fixing at least one of the cover parts, most often the rearmost cover portion along the rearside of the container in order to prevent the swingable cover part from disturbing the emptying operation when the bottom of the container is turned upwards. Another known front loading container is provided with an upper cover plate member which is hinged along an upper rearside edge of the container which by the emptying of the container causes the cover plate member to extend down into the collecting receptacle and thereby partly counteracting the emptying of the contents of the container. As can readily be appreciated, the last-mentioned front loading container, if the cover plate was just hinged along an upper rearside edge of the container, then the cover plate would be allowed to extend into the collecting receptacle when the bottom of the container is turned upwardly because nothing prevents the cover plate from swinging open in relation to the container. This would result in the cover plate disturbing the emptying operation. Furthermore, this construction of the container causes that the container must be lifted by a extra height by the emptying operation in order to allow the cover plate member to open sufficiently. Furthermore from DK-B1-140 980, it is known, that a container includes a particularly arched cover over an upper emptying opening by which the arched cover is furthermore provided with an guiding means being adapted to cooperate with guiding racks on the trucks. This construction complicates and makes more expensive the container as well as the truck. Finally, it is known a container of the type in question which includes a top end with two-sided inclined sides of which one inclined side is hinge connected along "the roof ridge" so that this inclined side by emptying, automatically is opened. However, also this container involves an inappropriate emptying operation, because an extra height lift that is needed. And the same situation is the case with a waste container known from DE-A1-29 13 436.

SUMMARY OF THE INVENTION

The invention provides an improved container, in particular a waste container, of the introductory described type, and by means of which the above disadvantage are eliminated.

According to the invention, the container includes a wall portion which can be opened, an upper plane cover plate member which at opposite side portions are swingably and displaceably connected with upper side edge portions of the container in such a manner that the cover plate member when the cover plate member is turned upwards, for example, when the container is standing on the ground, may be displaced and be swung away from the container in order to open one side thereof. The cover plate member, when turned downwards, for example, during the emptying of the container, automatically during displacement may be swung away from the container in order to empty the container, and the cover plate member, when it is again turned upwards, i.e. after the emptying of the container, automatically during displacement may again be swung backwards for closing the container. Hereby, an improved container of the type in question as a result of the combined displacement and swinging of the cover plate member with respect to the container makes possible a simple and functionally correct automatic opening with minimum sidewards displacement of the cover plate member when the container during the emptying is swung upwardly and rearwardly and is turned around over the filling opening of the collecting receptacle. Furthermore, a very important advantage is obtained by the container that the cover plate member thereof, when the container is standing on the ground, may easily be manually pushed rearwardly and may be swung upwardly to a vertical position along the rear wall, for example, that the container may be used for mechanical filling with waste or other material through open top side. Also for filling in the waste, the cover plate member may be only partially opened without requiring additional exertion.

Appropriately, the container is furthermore constructed such that at a rear side wall of the container is provided with interconnected engagement means being adapted to cooperate with shaped guiding means along opposite side edge portions of the cover plate member in that this by displacement and swinging, respectively, in relation to the container body may retain its orientation with the side edge portions may be approximately perpendicular to an upper edge portion of the rear side wall, and that the container at opposite side walls is provided with upper approximate horizontal carrying side members for support rollers mounted at said edge portions of the cover plate member. Hereby, it is obtained a simple and functionally correct parallel guiding of the cover plate member with respect to the container such that the cover plate member simultaneously may also be swung upwardly with respect to the container.

In a preferred embodiment, the container according to the invention is constructed such that the engagement means include gear wheels secured to opposite ends of a common shaft. The common shaft is pivotally arranged in suitable bearing brackets secured to the rearside wall and located outside of the gear wheels. The shaft is pivotally arranged on support rollers, and the guiding means located along said side edge portions of the cover plate member secured to toothed racks are parallel to side members of the cover plate member said gear wheels at the respective ends of the common shaft are in engagement with the toothed racks in which engagement is ensured by the engagement of the support rollers with said side members. In a simple manner, the common shaft at the rearside of the container in this way may form a two-sided parallel guiding member for the cover plate member as well as a swing axis.

Appropriately, said guiding means (the toothed racks) stretch along said side edge portions of the cover plate member from the rearside thereof and inwards to about the middle of the cover plate member which in the closed position of the container projects a small amount over said rearside wall of the container.

In order to minimize the downwardly projection of the cover plate member into the collecting receptacles during the emptying of the container, there is provided, inside the container between said rearside wall and the cover plate member, flexible link means with a specific length such that the cover plate member, when it is turned downwardly, i.e. during emptying of the container, is automatically forced to be rearwardly displaced in relation to the container. At the same time the cover plate member is swung outwardly in relation to the container body. And the flexible link means may appropriatly include simple chains which are secured inside to the rearside wall and to the underside of the cover plate member adjacent to the internal ends of said toothed racks, respectively.

Alternatively, the container may be constructed such that the container along opposite upper side wall portions is provided with guiding means which are adapted to cooperate with such interconnected and such shaped engagement means at opposite side edge portions such that the cover plate member by displacement and swinging, respectively, in relation to the container body may retain its orientation with the side edge portions are approximately parallel to said side wall portions, and that the container at opposite side wall are provided with upper approximate horizontal carrying side members for support rollers mounted at said side edge portions of the cover plate member.

In the following the invention is described in more detail, reference being made to the accompanying drawing, in which:

FIGS. 1A-1C are plane side views illustrating the handling principle of the container according to the invention, FIG. 2 a view showing the combined displacement and swinging principle by the cover plate member of a container according to the invention, FIGS. 3A-3C are side views showing manual displacement and swinging of the cover plate member of a container according to the invention, FIG. 4 shows in more detail how the cover plate member of the container according to the invention is swung out when the container, during the emptying operation is turned around, FIG. 5 a side view partly in section an embodiment for a container according to the invention, while FIG. 6 is a cross sectional view through a corner partion of a container according to the invention.

Figure 1A:
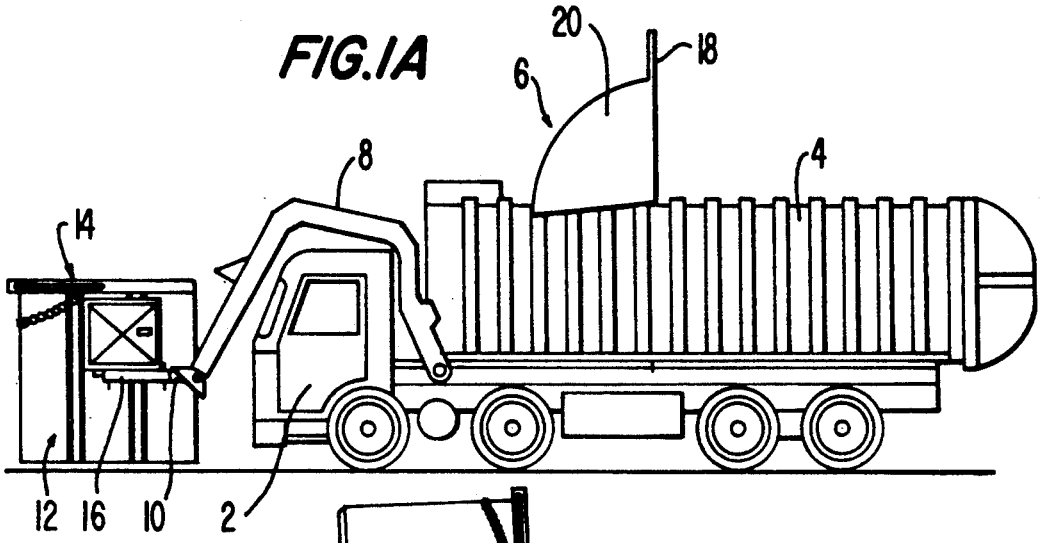
Figure 1B:
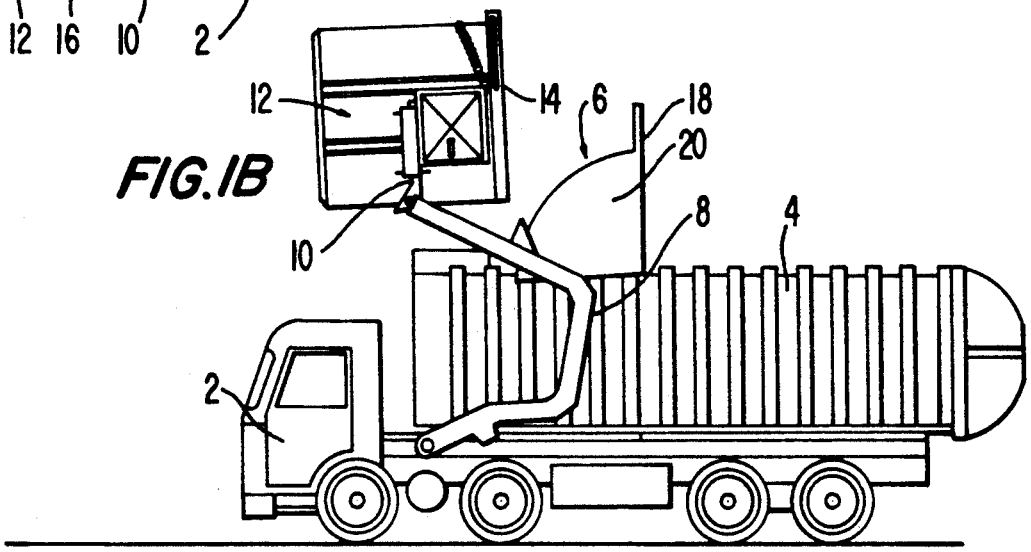
Figure 1C:
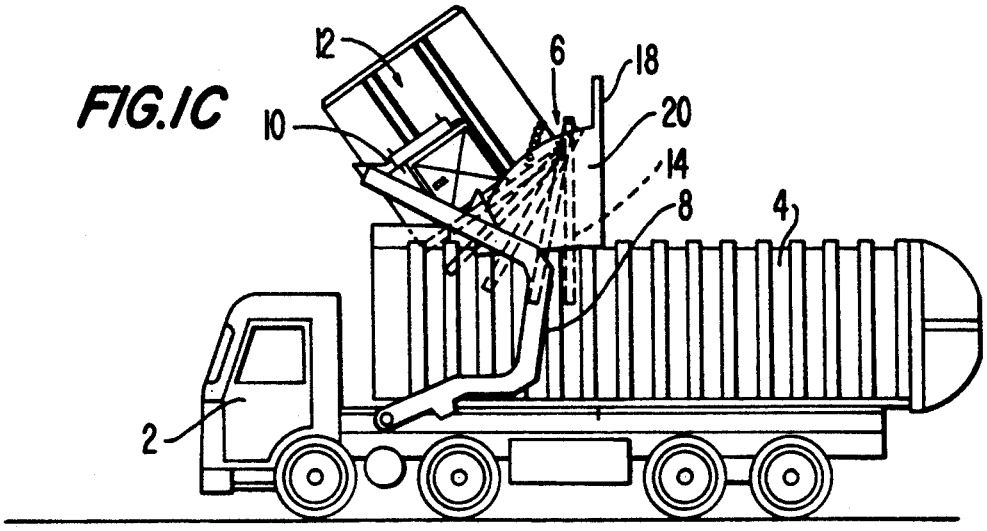

In FIGS. 1A-1C, a truck 2 is shown with a collecting receptacle 4, a closeably filling opening 6 and a front mounted fork-lift 8 with lifting forks or lifting arms 10. Additionally a container 12 is illustrated according to the invention with a cover plate member 14. In FIG. 1A, the container 12 is ready to be emptied by means of the fork-lift 8 of the lorry; the lifting arms 10 of which are inserted into side mountings 16 are secured to the opposite external sides of the container 12. The insertion of the lifting arms 10 is carried out by forward driving with the truck 2 since the driver from the driver's cab may control the whole emptying operation. In FIG. 1B, the container 12 has already been lifted upwardly and rearwardly across the driver's cab of the truck and the container 12 is turned over filling the opening 6 which before the emptying operation has been opened by swinging upwardly and rearwardly the lid 18 having arched side parts 20 when the lid 18 is swung down over the filling opening and is placed along opposite outer sides of the collecting receptacle 4 which includes an internal compacting The internal compacting system is continuously compacting and moves rearwardly the waste towards an emptying opening at the back of the truck 2. In FIG. 1C, the container 12 has been further turned around so that the cover plate member 14 as shown in more detail has automatically been opened by a combined displacement and swinging movement in relation to the container 12, so that the contents of waste or other material may be emptied into the collecting receptacle 4. It should be mentioned that the container 12 in FIG. 1C should be swung back towards the lid 18. And as shown more clearly in FIG. 1C, the cover plate member 14 of the container 12 in fact projects down into the collecting receptacle 4.

After the emptying of the container 12, the container is swung and carried back and is again placed on the ground, and the cover plate member 14 is simultaneously carried back to its normal closing position on the container 12.

Figure 2:
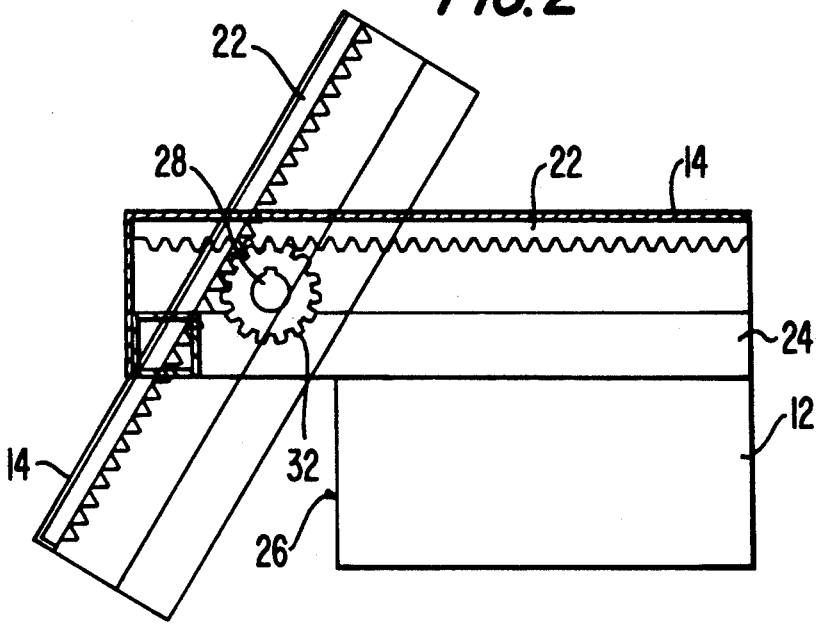
Figure 5:
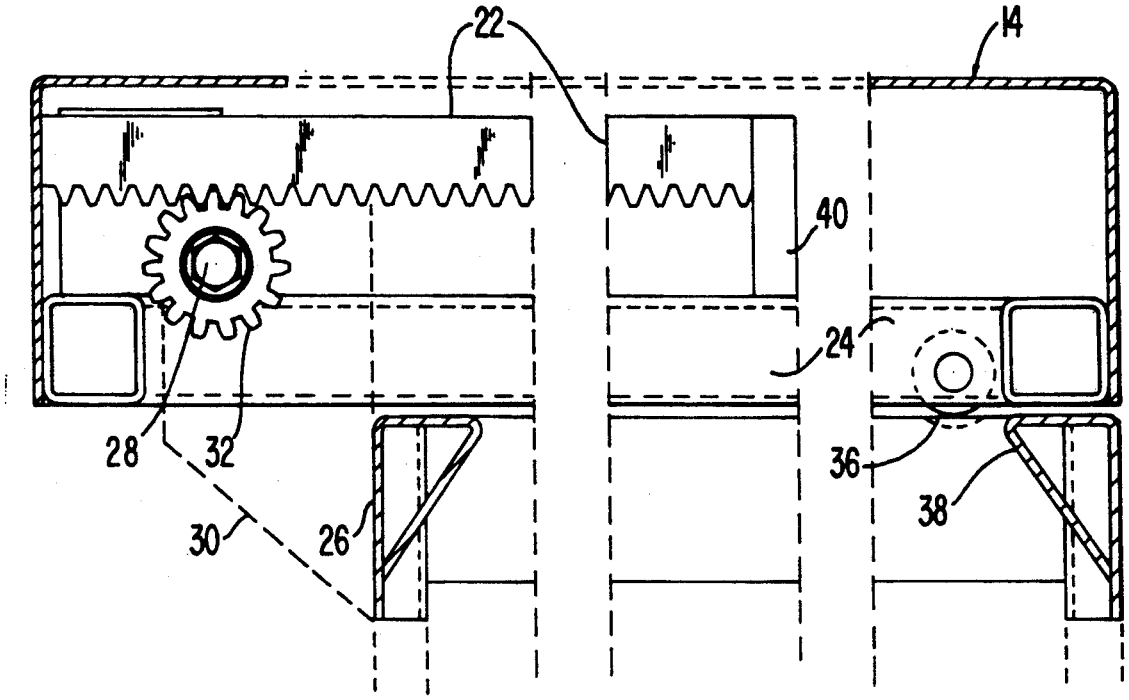
Figure 6:
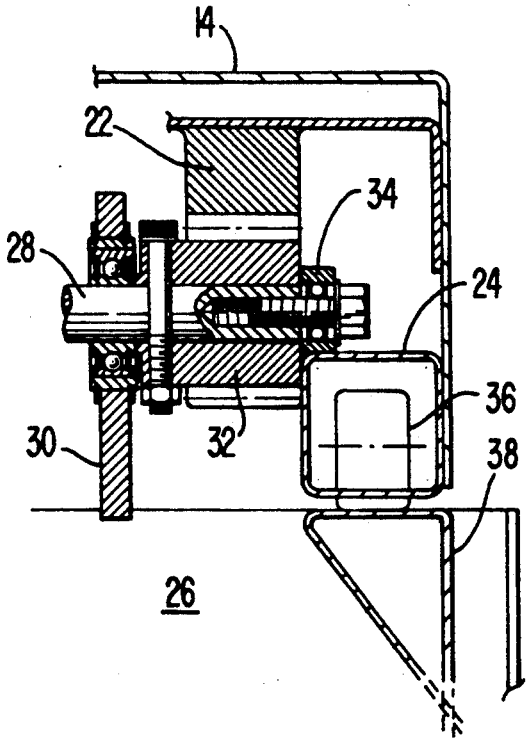

FIG. 2 shows a guiding operation between the container 12 and the cover plate member 14. The later is at least along a partial length of opposite side edge portions provided with a toothed rack 22 and with surrounding frame 24. The container is provided at an upper side edge of a rearside wall 26 with a transverse shaft 28 as illustrated in also FIGS. 5 and 6 which is pivotally supported on rearwardly projecting bearing brackets 30 secured to the rearside wall 26. Gear wheels 32 are secured on opposite ends of the shaft 28; the gear wheels 32 are engaged with the toothed racks 22, and the gear wheels 32 are pivotally arranged on the ends of the shaft 28, and supporting rollers 34 engage the top side of side portions of the frame 24 to ensure correct and constant engagement between the gear wheels 32 and the toothed racks 22 so that the cover plate member 14 retains its correct orientation with the side edge portions perpendicular to the rearside wall 26 since an internal portion of the gear wheels 32 is additionally guided along the internal side of said side portions of the frame 24. Adjacent to the cover plate member 14 are carrying rollers 36 mounted at front corners in the frame 24 and rolling supported on an upper side edge portion of an upper surrounding frame 38 of the container body, for example the cover plate member 14 is rollingly supported in relation to the container body partly by the gear wheels 32, the supporting rollers 34 and the carrying rollers 36 so that the cover plate member 14 is easy to displace manually in the rearward direction as illustrated in FIGS. 3A-3C.

Figure 3C:
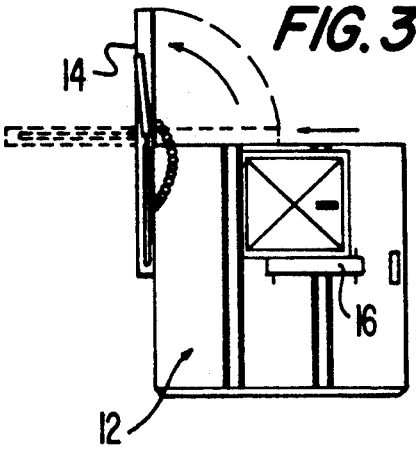
Figure 3B:
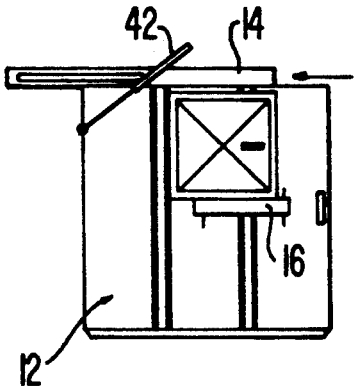
Figure 3A:
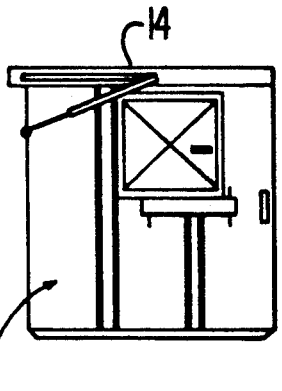

In cases, where the container 12 is being filled or loaded by means of excavator or the like, it is easy to open the upper side of the container by first pushing the cover plate member 14 rearwardly (FIG. 3B) and thereafter to swing the cover plate member downwardly to the position shown in FIG. 3C, where the container body is open for manual or mechanical filling with material. The length of the toothed racks 22 and the position of end stop means 40 for these are adjusted such that the cover plate member 14 is almost in equilibrium when the cover plate member 14 is carried entirely rearwardly in relation to the container body, for example that no considerable use of force is needed for the manual opening of the container 12.

Figure 4:
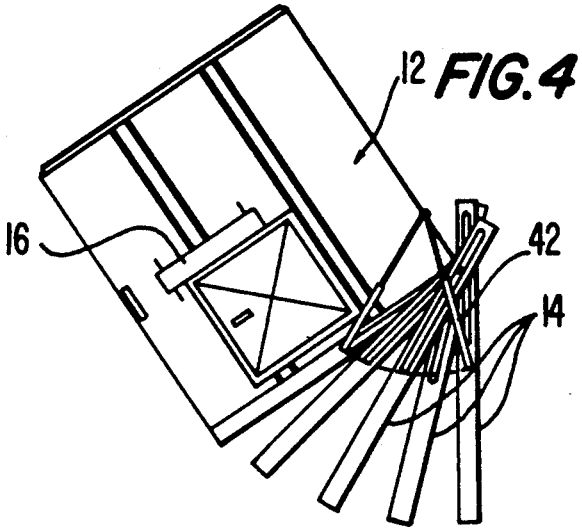

In FIGS. 3A-3C and FIG. 4 is an external guiding rod 42 is shown mounted between the cover plate member 14 and the container 12. These guiding rods 42 which in practice are substituted by internal chains being secured at almost the same positions of the respective parts, the cover plate member 14 and the rearside wall 26 serve to limit the downwards carrying of the cover plate member 14 when the container 12 is emptied due to the influence of the gravity is swung downwardly and rearwardly so that the cover plate member instead automatically is forced to be displaced rearwardly and upwardly in relation to the container 12 as illustrated in FIG. 4, where the swinging out of the cover plate member 14 is shown in more detail. For manual handling of the cover plate member 14 this may be provided with handles not shown at the front and rear sides.

Figure 7A:
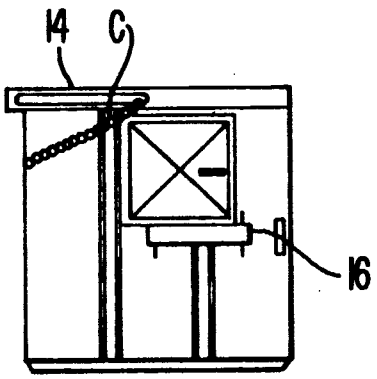
FIG. 7A is a schematic side view of the container with the cover plate member closing the container with chains.
Figure 7B:
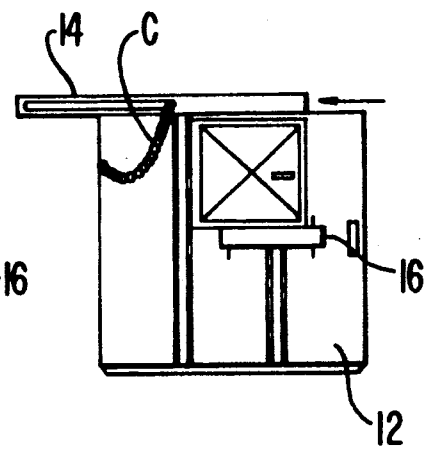
FIG. 7B is a schematic side view of the container with the cover plate member partially extended with chains.
Figure 7C:
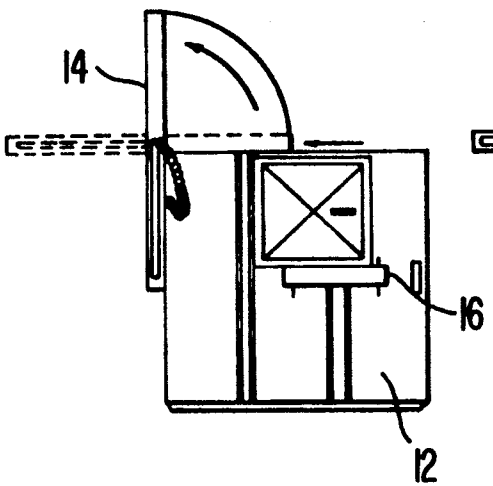
FIG. 7C is a schematic side view of the container with the plate cover member fully extended with chains.

As shown in FIGS. 7A-7C, the container may have restriction means or flexible chains C that have a length and are connected between the rearside wall of the container 12 and the inside of the cover plate member 14 adjacent to the ends of the toothed rails so that when the waste container 12 is pivoted to the inverted position, the cover plate member 14 is automatically moved rearwardly with respect to the waste container 12 while the cover plate member 14 is pivoted outwardly with respect to the container body.

I claim:

1. A waste container for transporting and emptying waste by being lifted and swung upwards and rearwards to a collecting receptacle of a vehicle, the waste container comprising a container body; a cover plate member; insertion means for accepting lifting forks of the vehicle; and engagement and pivot means for pivotally connecting said cover plate member with said container body, wherein the cover plate member, when the waste container is placed in an upright position, is transversely slid and pivoted from the container body to open the top side thereof so that the waste is placed in the waste container, and wherein the waste container further comprises restriction means pivotally connected between the container body and the cover plate member to restrict the pivoting of the cover plate member with respect to the container body and to force the cover plate member to be transversely slid and pivoted over a rearside of the container body, when the waste container is pivoted to an upside-down position automatically pivot open the cover plate member from the container, and wherein the cover plate member, when the waste container is swung to the upright position, automatically is transversely slid and pivoted closed with respect to the container body by gravitational pull.

2. A container according to claim 1, wherein said engagement and pivot means includes a transverse shaft at opposed side edge portions of the cover plate member, and a toothed rack including gear wheels cooperating with said toothed rack and being secured at opposed ends of said transverse shaft, said container body including brackets, said transverse shaft being pivotally supported on said brackets projecting from a rearside wall of the container body, and wherein the container body retains an orientation with said side edge portions by stopping movement of the cover member approximately perpendicular to an upper edge portion of the rearside wall as the cover member is pivoted, and wherein the container body at opposed side walls of the container body includes substantially horizontal upper carrying frame members including rollers mounted at said side edge portions of the cover plate member, and adjacent to the gear wheels on the transverse shaft and said rollers being pivotally arranged by aligning the toothed rack and the gear wheels.

3. A container according to claim 2, wherein the toothed rack extends from the rearside of the cover plate member to a middle of the cover plate member and wherein said cover plate when closed projects over said rearside wall of the container body.

4. A container according to claim 1, wherein said restriction means are flexible chains having a length and connected between the rearside wall of the container and inside of the cover plate member adjacent to ends of the toothed rack so that when the waste container is pivoted to the upside-down position, the cover member is automatically moved rearwardly with respect to the waste container while the cover plate member is pivoted outwardly with respect to the container body.

* * * * *